US005637022A

United States Patent [19]

Koike et al.

[11] Patent Number: 5,637,022

[45] Date of Patent: Jun. 10, 1997

[54] SWITCH APPARATUS FOR MARINE PROPULSION UNIT

[75] Inventors: Takashi Koike; Ryozo Okita, both of Shizuoka-ken, Japan

[73] Assignee: Sanshin Kogyo Kabushiki Kaisha, Hamamatsu, Japan

[21] Appl. No.: 511,013

[22] Filed: Aug. 3, 1995

[30] Foreign Application Priority Data

Aug. 4, 1994 [JP] Japan ..... 6-183597

[51] Int. Cl.[6] ..... B60K 41/00

[52] U.S. Cl. ..... 440/87

[58] Field of Search ..... 440/84–87

[56] References Cited

U.S. PATENT DOCUMENTS 2,909,146 10/1959 Strang ..... 440/85

5,083,951 1/1992 Baba ..... 440/87

*Primary Examiner*—Jesus D. Sotelo

*Attorney, Agent, or Firm*—Knobbe, Martens, Olson & Bear LLP

[57] ABSTRACT

A control switch assembly for utilization with marine propulsion units to be mounted in, for example, the single lever housing of the transmission and throttle control. The switch assembly includes a sealed outer housing providing at least two cavities for containing switches and a hard wire interconnection to an external terminal for connection to a wire harness.

12 Claims, 6 Drawing Sheets

SWITCH APPARATUS FOR MARINE PROPULSION UNIT

BACKGROUND OF THE INVENTION

This invention relates to a switch apparatus for a marine propulsion unit and more particularly to an improved, simplified and compact electrical control for such propulsion unit.

In many forms of marine propulsion controls there are provided a plurality of switches, normally including a main switch, for controlling various aspects of the propulsion unit. For example, these switches frequently include in addition to the main switch, that supplies main electrical power to the engine, a starter switch and/or a kill switch. In order to provide ease of operation and installation, frequently these switches are all mounted in a common control element or control panel. Frequently this common control element may be the housing assembly of a single lever control which controls both the speed of the engine of the propulsion unit and the condition of its transmission.

Obviously, it is necessary for the switches to be electrically connected to the power source, to the control element of the switch, and to the element which they control. This requires considerable wiring and thus provides a time consuming assembly. Such arrangements also introduce the possibility of electrical failures either on installation or upon use.

It is, therefore, a principal object of this invention to provide an improved switch apparatus for a marine propulsion unit.

It is a further object of this invention to provide an improved sealed switch apparatus embodying several switches for the marine propulsion control and which are incorporated in a common sealed housing which has a hard wire circuitry encompassed therein so as to minimize the number of external controls and connections.

SUMMARY OF THE INVENTION

This invention is adapted to be embodied in a switch assembly for controlling a propulsion unit. The switch assembly is comprised of an outer housing assembly that sealingly encloses an area containing at least the major portions of a main switch assembly and at least one other switch assembly. At least the main switch assembly has an actuating portion that is external from the outer housing assembly for external operation of this switch assembly. A plurality of hard wire conductors are contained within the outer housing assembly and connect the switches with at least a pair of terminals that extend through the outer housing assembly for connection to a connector for electrical interconnection to other components.

DETAILED DESCRIPTION OF THE PREFERRED EMBODIMENTS OF THE INVENTION

Figure 1:
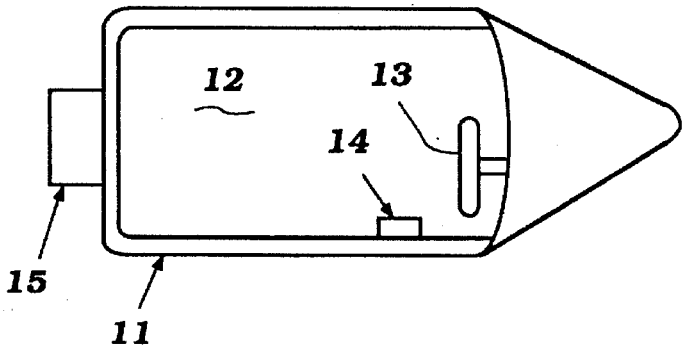
FIG. 1 is a partially schematic top plan view of a watercraft having a propulsion unit and control system constructed in accordance with an embodiment of the invention.
Figure 2:
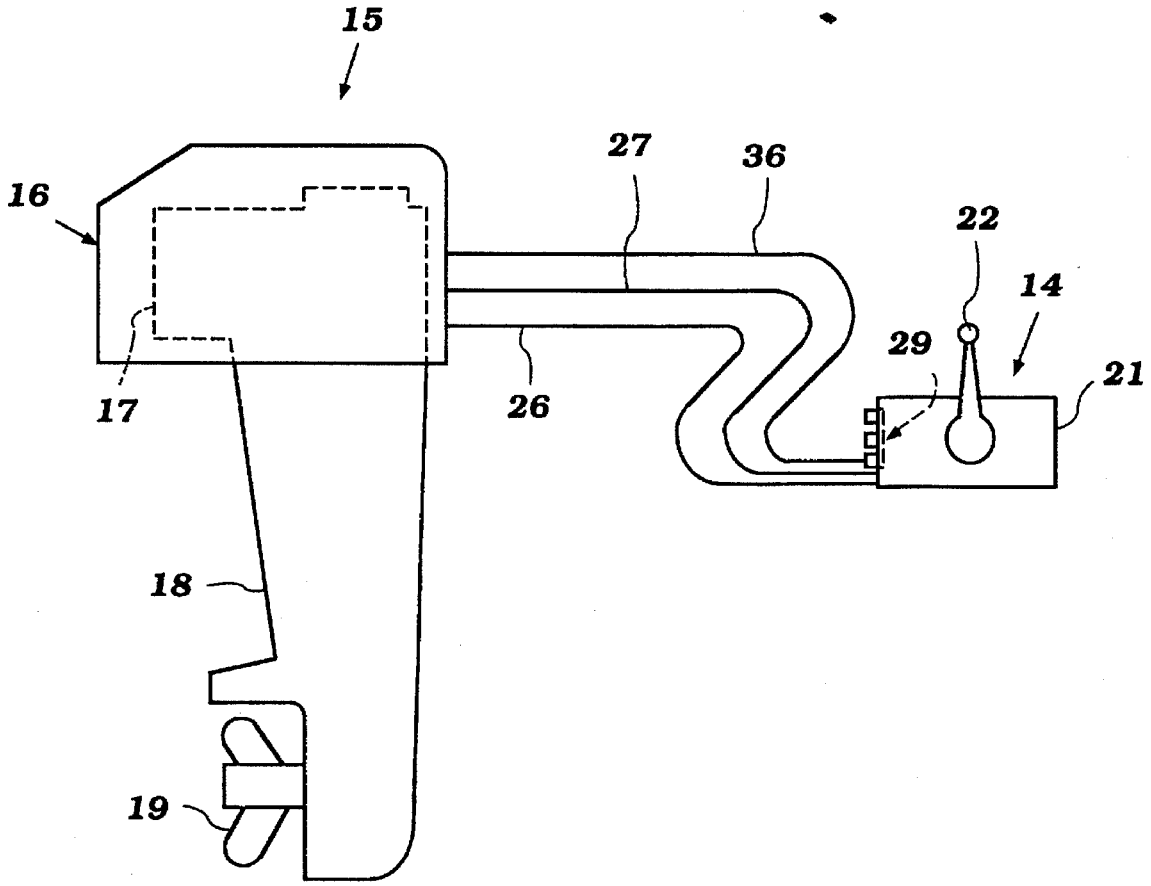
FIG. 2 is a partially schematic side elevational view showing the interrelationship of the control and the propulsion unit for the watercraft.

Referring now in detail to the drawings and initially to FIGS. 1 and 2, a watercraft embodying this invention is shown in part schematically in FIG. 1 and is identified generally by the reference numeral 11. For the reasons aforenoted, a watercraft is a typical environment in which the invention may be found to have particular utility. The watercraft 11 is provided with a rider's compartment 12 in which certain controls such as a steering wheel 13 and single lever control 14 are provided for controlling the propulsion unit, indicated generally by the reference numeral 15.

Referring now primarily to FIG. 2, the single lever control 14 is mounted in proximity to the rider or operator's position adjacent the steering wheel 13 and is connected to the propulsion unit 15 in a manner which will be described.

The propulsion unit 15 is, in the illustrated embodiment, an outboard motor that is comprised of a powerhead 16 having a powering internal combustion engine 17 which may be of any known type. As is conventional with outboard motor practice, the engine 17 is mounted in the powerhead 16 so that its output shaft rotates about a vertically extending axis. This facilitates connection to a vertically extending drive shaft (not shown) that is journaled for rotation within a drive shaft housing 18 that depends from the powerhead 16.

In a lower unit of the drive shaft housing 18, there is provided a conventional forward-neutral-reverse type of transmission for driving a propeller 19 on selected forward and reverse directions or for establishing a neutral condition wherein the engine 17 can idle without driving the propeller 19.

Figure 3:
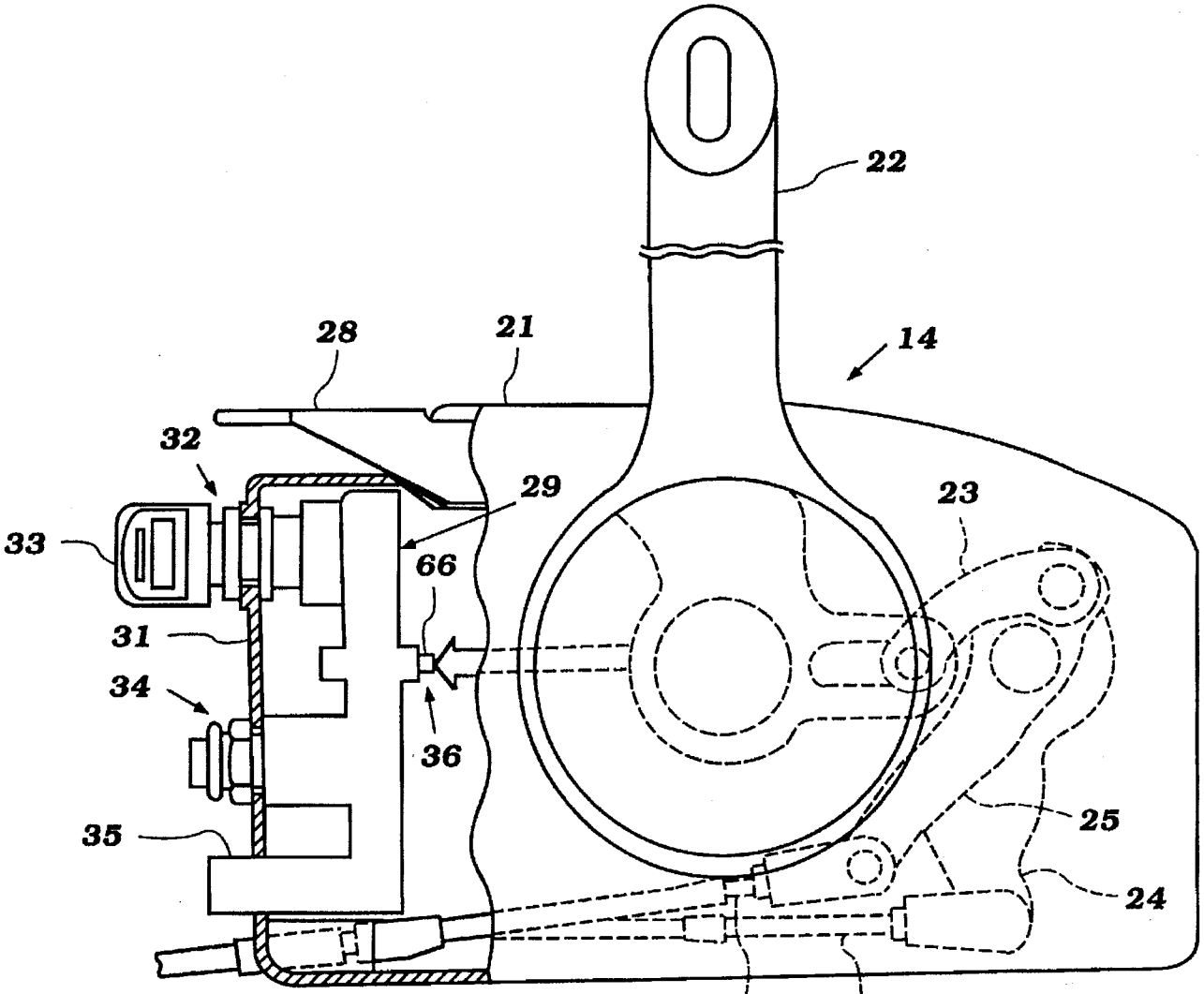
FIG. 3 is an enlarged view looking in the same direction as FIG. 2 and shows the control with a portion broken away so as to more clearly show the construction.

Referring now in detail primarily to FIG. 3, the single lever control 14 is of a type well known in this art and employs an outer housing assembly 21 that is adapted to be detachably affixed to the watercraft hull in a known manner. A control lever 22 is rotatably journaled by this outer housing assembly 21 and is disposed so that it can be easily operated by the operator, as aforenoted. The control lever 22 is connected by means of a linkage assembly 23 to a pair of control levers 24 and 25. The lever 24 is connected to a bowden wire actuator 26 which, in turn, is connected to the outboard motor 15 and specifically the transmission actuator thereof. The operation is such that when the single control lever 22 is moved from a neutral position as shown in FIG. 1 to either a forward, clockwise direction or a rearward, counterclockwise direction, the transmission for the propeller 19 will be shifted from the neutral position to either the forward or reverse drive positions. During this time period the other control lever 25, which is the throttle control, will be maintained stationary.

The throttle control 25 is connected by a bowden wire assembly 27 to the speed control of the engine 17. Once the single lever control 22 has been moved from the neutral position to either the forward or reverse drive position, continued movement of the control lever will not cause any movement of the transmission control lever 24. However, at this time, and regardless of the direction the control lever 22 is moved, the throttle lever 25 will be actuated so as to operate the throttle control wire actuator 27 and increase the speed of the engine. As has been noted, this type of mechanism is well known in the art and further description of it is not believed to be necessary.

The single lever control mechanism 14 may also be provided with a warm-up control lever 28 which is also connected to the throttle control 27 for increasing the speed of the engine when operating in neutral for a quicker warm-up.

The construction as thus far described may be considered to be conventional. In accordance with the invention, a switch assembly, indicated generally by the reference numeral 29, is mounted within the single lever control housing 21 in such a way that certain portions of it, as will be described, are accessible through a rear face 31 of the housing 21. These externally accessible components include a main switch actuator 32 designed to be operated by a key 33, a kill switch 34, and an electrical connector 35, which is connected to a wire harness 36 for providing electrical power and control signals between the switch assembly 29, the propulsion unit 15, and a source of electrical power, as will be described. In addition, the switch assembly 29 includes a neutral detector switch 36 which is actuated, in a manner to be described, by the position of the single lever control 22 so as to provide a signal when the transmission is in neutral. By this way, it can be insured that the starter switch, which is actuated by the main switch 32 in a manner which will also be described, cannot be initiated except when the transmission is in neutral and the engine speed is set at idle or fast idle as determined by the warm-up lever 28.

Figure 4:
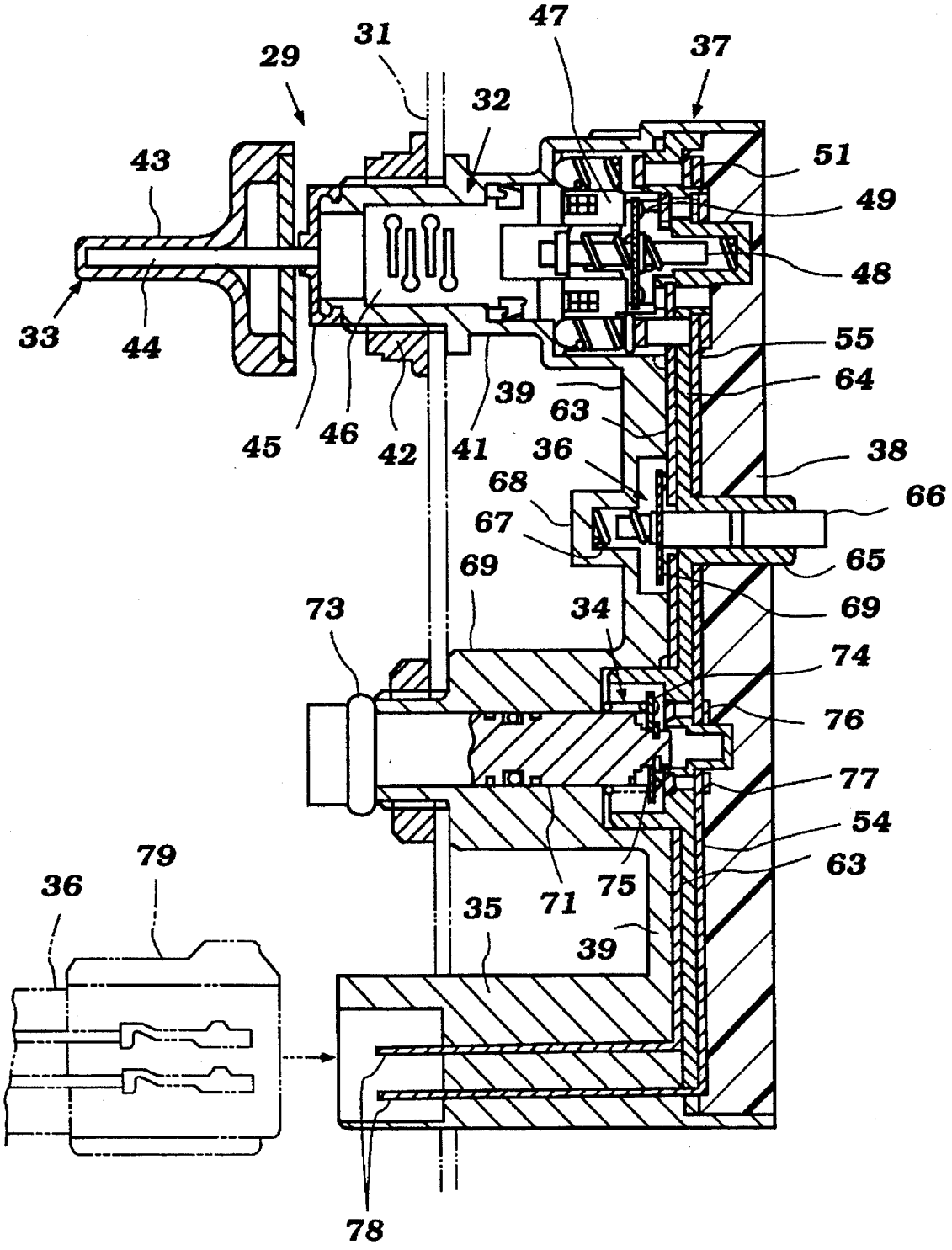
FIG. 4 is a further enlarged cross-sectional view showing the electrical control portion of the assembly with the main single lever control housing shown in phantom.

The switch assembly 29 will now be described initially by primary reference to FIGS. 4 and 5. The switch assembly 29 includes an outer housing assembly, indicated generally by the reference numeral 37 which is formed from insulators comprised of an insulating base plate 38 to which a cover plate 39 is sealingly affixed so as to define a number of internal cavities in which the major portions of the main switch 32 and of the kill switch 34, as well as the main portions of the neutral detector switch 36, are contained.

Referring first to the main switch 29, the outer housing cover piece 39 has an outwardly extending portion 41 that extends through an opening in the single lever control outer housing rear wall 31. A bezel 42 affixes in part the housing assembly 39 to this wall 31 and provides security around the housing portion 41.

The key 33 has an insulated handle portion 43 and a blade 44 that is adapted to pass through a seal 45 formed over the outer end of the housing extension 41 and adjacent the bezel 42 for sealing purposes. The blade has a further portion 46 that cooperates with a suitable keying mechanism so as to control the rotation of a wiper switch 47 when the appropriate key is inserted.

Figure 5:
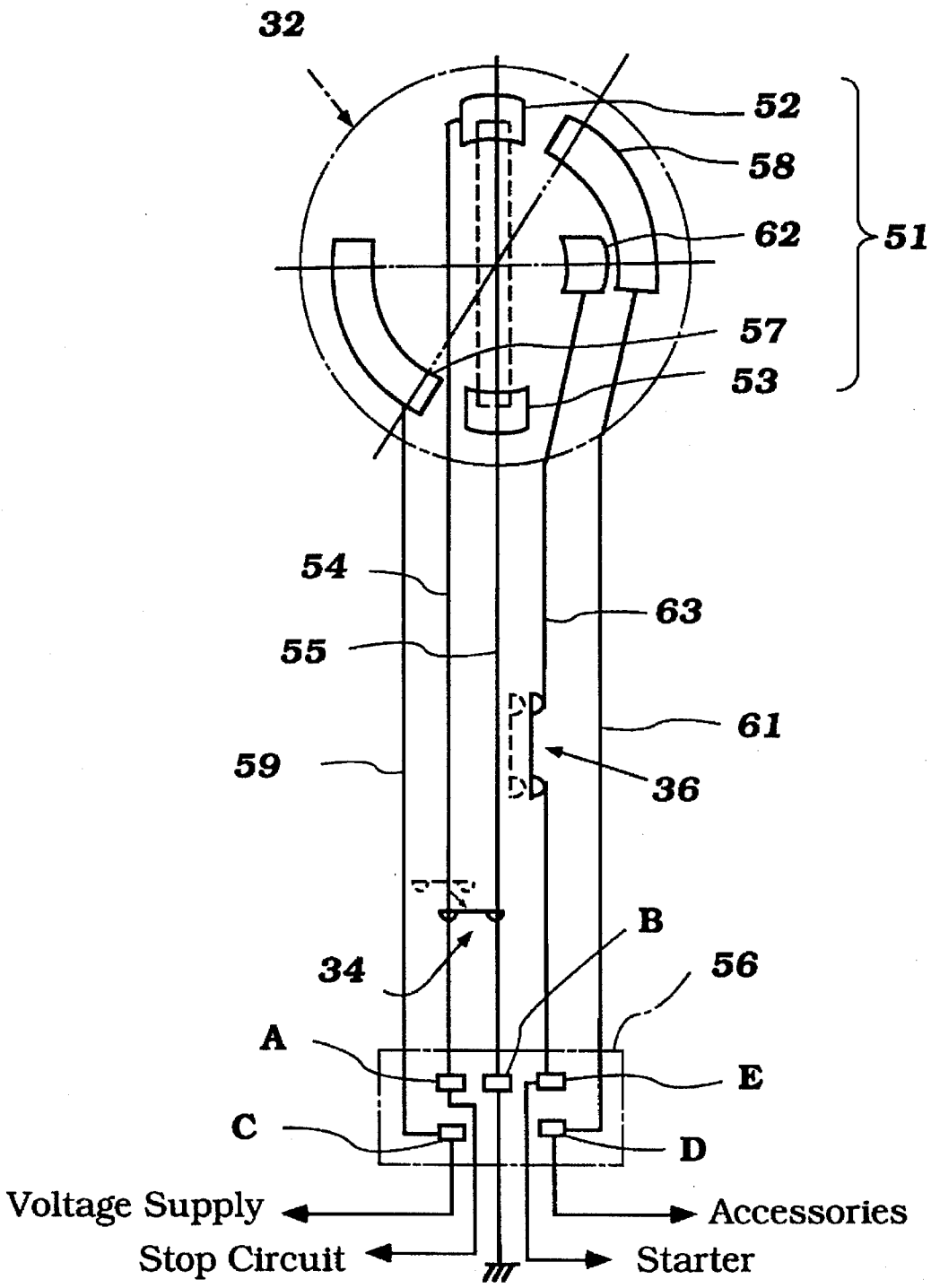
FIG. 5 is a schematic view showing the electrical connections associated with the main switch.

The wiper switch 47 has an extension 48 that extends into a cavity formed in the housing piece 36 and carries a wiper terminal element 49 that is adapted to cooperate with certain terminals formed in the housing assembly 37 and which terminals are indicated generally by the reference numeral 51 and are illustrated in more detail in FIG. 5.

The terminals 51 include a pair of off-condition terminals 52 and 53 which are diametrically opposed and are connected by means of conductors 54 and 55, respectively, to switch terminals A and B of a terminal box 56. When the main switch 29 is in its off position, electrical contact will be established between the off terminals 52 and 53 and their respective conductors 54 and 55 and the switch terminals A and B as is well known in the art. It should be noted that the conductors 54 and 55 are in fact hard-wired into the housing assembly 37 and are carried on a flexible board 64 that is captured between the cover plate and the insulating base 38 of the housing assembly 37. This electrical circuit is thus a printed circuit or the like.

The main switch assembly 29 and specifically its portion 32 also includes a pair of "on" terminals 57 and 58, which form further portions of the terminals 51. These "on" terminals 57 and 58 are connected by further hard wires 59 and 61 contained within the housing assembly 37 to further switch terminals C and D of the terminal box 56. It should be noted that the terminals 57 and 58 and the hard wires 59 and 61 do not actually appear in FIG. 4, but from the diagram of FIG. 5 those skilled in the art can readily understand how they will be laid out within the insulated housing 37.

Finally, the terminals 51 further include a starter terminal 62. The starter terminal 62 is in circuit with a hard wire 63 which does appear in FIG. 4 and which is connected in a manner to be described to the starter relay circuit for energizing the starter. This terminal is provided by the terminal E of the terminal box 56.

The hard wire conductor 63 is interrupted within the housing 37 and its connection is closed by the neutral detector switch 36 which will now be described also by reference to FIGS. 4 and 5. The printed circuit board has a projection 65 that extends rearwardly within the single lever control housing 21 and slidably supports a plunger 66. The plunger 66 forms an integral element of the neutral detector switch 36 and is engaged by a cam on the appropriate element of the single lever control 22 so as to reciprocate the plunger against the action of a spring 67 when the control lever 22 is moved to a position other than its neutral position.

Figure 6:
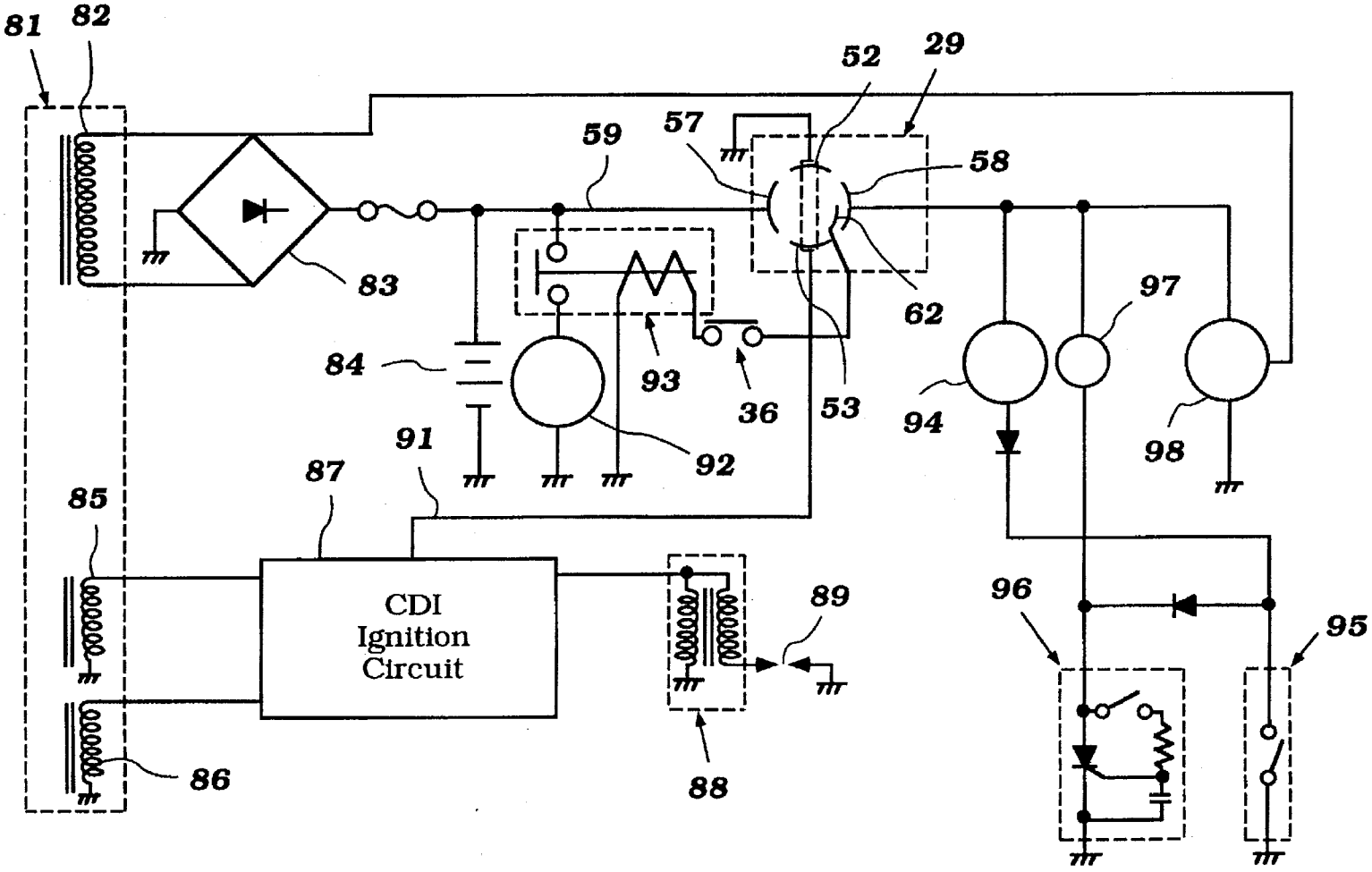
FIG. 6 is a schematic diagram showing the electrical system.

The spring 67 is contained within a cavity formed by a projection 68 of the cover piece 39 and normally holds a conductive terminal 69 fixed to the plunger 66 into contact with the open portions of the hard wire conductor 63 so as to maintain a normally closed position of the neutral detector switch 36 when the transmission is in its neutral position. However, if the transmission is shifted out of neutral, then the aforenoted lug engages the plunger 66, compresses the spring 67, and opens the circuit so that starting cannot be effected. This construction will become more apparent when the total circuit of FIG. 6 is described.

Referring now to the kill switch 34 again by reference to FIGS. 4 and 5, the cover piece 39 of the housing assembly 37 is provided with a further projection 69 that slidably supports a plunger 71. The projection 69 extends through an opening in the control housing rear face 31. A bezel 72 is affixed to this extending projection and holds the housing 37 to the single lever control housing 21. The plunger 72 has an externally sealed actuating portion 73 by which the plunger may be urged in a direction in opposition to a return spring contained within the sealed portion 73 so as to bring a terminal 74 that is biased by a spring 75 into engagement with a pair of terminals 76 and 77 carried by the housing piece 38 so as to establish a connection across the hard wire conductors 54 and 55. This will ground the ignition circuit, in a manner to be described, and thus disable the firing of the spark plugs of the engine 17 so as to stop the engine running in a manner known in this art.

Certain of the conductors thus far described and specifically the terminals A, B, C, D and E are provided with tab terminals 78 that extends through the projecting portion 35 of the cover piece 39 and which cooperate with a mating female terminal 79 so as to establish the electrical connections afore referred to.

The overall electrical circuit will now be described by particular reference to FIG. 6 wherein certain components already described are illustrated. The engine 17, as is typical with outboard motor practice, is provided with an engine flywheel driven magneto generator, indicated generally by the reference numeral 81. This includes one or more charging coils 82 which are connected to a rectifier voltage supply circuit 83 which, in turn, supplies power to a battery 84 for charging it in a well known manner.

In addition, there is provided at least one charging coil 85 and a pulser coil 86 that supply electrical power and timing signals to a CDI ignition circuit, indicated schematically at 87. This CDI ignition circuit 87 provides a signal to a spark coil 88 that is associated with the spark plugs 89 of the engine 17 for firing them in accordance with any desired control strategy. When the main switch 29 is turned to its off condition so that the terminals 52 and 53 are connected and the kill switch 34 is closed, the CDI ignition circuit 87 will be grounded through a conductor 91 and the firing of the spark plugs disabled. This will effect stopping of the engine 17 in a manner well known in this art.

The starter arrangement is also shown and the starter motor is indicated schematically at 92. As has been previously noted, when the main switch 29 is turned to the starter position, a circuit is established across the starter terminal 62. At that time if the neutral switch 36 is closed, a starter relay 93 will be energized so as to supply electrical power to the starter motor 92 and crank the engine for starting.

Finally, certain of the accessories which are also operated off of the terminal 58 are shown in this figure and these include a warning buzzer 94 which will be energized if the engine temperature is higher than a desired temperature, as indicated by a thermal switch 95 or if the oil level for the lubricating system is excessively low, as indicated by an oil level switch 96. In addition, a warning oil lamp 97 will be illuminated if the oil level falls below a predetermined slightly higher level which is not indicative necessarily of an emergency condition but merely to warn the operator that oil should be added to the system. In addition, a tachometer 98 is powered by the system and provides an indication of engine speed.

Thus, from the foregoing description it should be readily apparent that the described switch assembly is very effective in providing all of the necessary switching functions with the elimination of substantial wiring and the possibility of using a wiring harness rather than separate wires. The connection between the switches is provided within the sealed housing 37 by the hard wire connections aforenoted.

Figure 7:
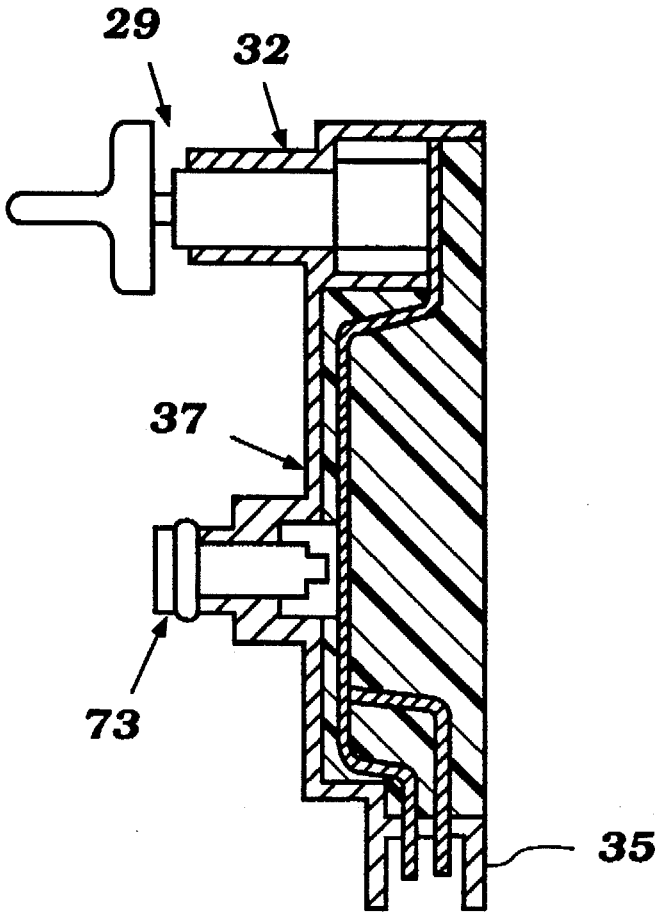
FIG. 7 is a reduced scale cross-sectional view, in part similar to FIG. 4, and shows another embodiment of the invention.

Of course, the switches can be arranged in a different orientation and also the terminal connector portion 35 may be differently oriented and such an arrangement is shown in FIG. 7. In this embodiment, the terminal section 35 extends perpendicularly to the main switch 32 and the kill switch 73. The neutral detector switch is not shown in this embodiment and it may in fact be deleted if desired. Various other changes and modifications may be made without departing from the spirit and scope of the invention, as defined by the appended claims. Of course, the foregoing description is that of preferred embodiments of the invention, and various changes and modifications may be made without departing from the spirit and scope of the invention, as defined by the appended claims.

We claim:

1. A switch assembly for controlling a propulsion unit, said switch assembly being comprised of an outer housing assembly sealingly enclosing an area containing at least the major portions of a main switch assembly and at least the major portion of one other switch assembly, at least such main switch assembly having an actuating portion extending from within said outer housing assembly for external operation of said main switch assembly, a plurality of hard wire conductors contained in said outer housing assembly and connecting said switches with at least a pair of quick disconnect electrical terminals extending through said outer housing assembly for connection to external sources through a wire harness.

2. A switch assembly for controlling a propulsion unit as set forth in claim 1, wherein at least the one other switch assembly comprises a transmission condition sensor switch.

3. A switch assembly for controlling a propulsion unit as set forth in claim 2, wherein there are a plurality of other switch assemblies contained within the outer housing and at least one of the other switch assemblies comprises a kill switch.

4. A switch assembly for controlling a propulsion unit as set forth in claim 1, in combination with a single lever control for controlling the throttle and transmission of an associated watercraft, said single lever control having a control housing assembly in which said outer housing assembly of said switch assembly is contained.

5. A switch assembly for controlling a propulsion unit as set forth in claim 4, wherein the at least one other switch assembly comprises a kill switch.

6. A switch assembly for controlling a propulsion unit as set forth in claim 4, at least the one other switch assembly comprises a transmission condition sensor switch.

7. A switch assembly for controlling a propulsion unit as set forth in claim 6, wherein there are a plurality of other switch assemblies contained within the outer housing and at least one of the other switch assemblies comprises a kill switch.

8. A switch assembly for controlling a propulsion unit as set forth in claim 7, wherein the outer housing assembly includes a base portion, a cover portion and at least one intermediate insulating member interposed between the hard wires for providing electrical insulation between them.

9. A switch assembly for controlling a propulsion unit as set forth in claim 8, wherein the hard wire conductor are mounted on the insulating member and the insulating member is relatively flexible.

10. A switch assembly for controlling a propulsion unit, said switch assembly being comprised of an outer housing assembly sealingly enclosing an area containing at least the major portions of a main switch assembly and at least the major portion of one other switch assembly, at least such main switch assembly having an actuating portion extending from within said outer housing assembly for external operation of said main switch assembly, a plurality of hard wire conductors contained in said outer housing assembly and connecting said switches with at least a pair of terminals extending through said outer housing assembly for connection to external sources, said at least one other switch assembly comprising a kill switch.

11. A switch assembly for controlling a propulsion unit, said switch assembly being comprised of an outer housing assembly sealingly enclosing an area containing at least the major portions of a main switch assembly and at least the major portion of one other switch assembly, at least such main switch assembly having an actuating portion extending from within said outer housing assembly for external operation of said main switch assembly, a plurality of hard wire conductors contained in said outer housing assembly and connecting said switches with at least a pair of terminals extending through said outer housing assembly for connection to external sources, said outer housing assembly includes a base portion, a cover portion and at least one intermediate insulating member interposed between the hard wire conductors for providing electrical insulation between them.

12. A switch assembly for controlling a propulsion unit as set forth in claim 11, wherein the hard wire conductor are mounted on the insulating member and the insulating member is relatively flexible.

* * * * *